US011553761B2

(12) United States Patent
Drake

(10) Patent No.: US 11,553,761 B2
(45) **Date of Patent: *Jan. 17, 2023**

(54) INCREASED ACCESS FOOTWEAR

(71) Applicant: NIKE, Inc., Beaverton, OR (US)

(72) Inventor: Brett Drake, Cheyenne, WY (US)

(73) Assignee: NIKE, Inc., Beaverton, OR (US)

( * ) Notice: Subject to any disclaimer, the term of this patent is extended or adjusted under 35 U.S.C. 154(b) by 155 days.

This patent is subject to a terminal disclaimer.

(21) Appl. No.: 16/940,013

(22) Filed: Jul. 27, 2020

(65) Prior Publication Data

US 2020/0352282 A1 Nov. 12, 2020

Related U.S. Application Data

(63) Continuation of application No. 15/955,386, filed on Apr. 17, 2018, now Pat. No. 10,758,010.

(60) Provisional application No. 62/486,311, filed on Apr. 17, 2017.

(51) Int. Cl.

| | |
|---|---|
| ***A43C 11/00*** | (2006.01) |
| ***A43C 11/14*** | (2006.01) |
| ***A43B 11/00*** | (2006.01) |
| *A43B 23/02* | (2006.01) |

(52) U.S. Cl.

CPC ..... *A43C 11/004* (2013.01); *A43B 11/00* (2013.01); *A43C 11/008* (2013.01); *A43C 11/1493* (2013.01); *A43B 23/0245* (2013.01)

(58) Field of Classification Search

None

See application file for complete search history.

(56) References Cited

U.S. PATENT DOCUMENTS

| | | | |
|---|---|---|---|
| 171,301 | A | 12/1875 | McKee |
| 417,460 | A | 12/1889 | Wurtele |
| 474,574 | A | 5/1892 | Bruzon |
| 503,588 | A | 8/1893 | Elterich et al. |
| 537,627 | A | 4/1895 | Bixby et al. |
| 558,937 | A | 4/1896 | Edmonds |
| 808,948 | A | 1/1906 | Roberts |
| 827,330 | A | 7/1906 | Tillson |

(Continued)

FOREIGN PATENT DOCUMENTS

| | | | |
|---|---|---|---|
| CN | 87209219 | U | 5/1988 |
| CN | 87103983 | A | 12/1988 |

(Continued)

*Primary Examiner* — Jila M Mohandesi

(74) *Attorney, Agent, or Firm* — Shook Hardy & Bacon, LLP

(57) ABSTRACT

An article of footwear providing easy donning and doffing through a heel region. A heel cup is pivotably coupled with the footwear to articulate between an open configuration allowing easier access to a foot-receiving cavity and a closed configuration enclosing a heel region of the footwear. A tensioning strap extends from a first side of the footwear around the heel cup to an opposite second side of the footwear when the heel cup is in the closed configuration. The heel strap is effective to structurally secure the heel cup in the closed configuration. One or more tensioning strands may extend from the tensioning strap. The tensioning strands may be effective to convert force provided through the tensioning strap across a forefoot portion to generate a forefoot securing force through a lacing mechanism.

19 Claims, 6 Drawing Sheets

(56) References Cited

U.S. PATENT DOCUMENTS 863,549 A 8/1907 Metz
925,337 A 6/1909 Gustafson
1,081,678 A 12/1913 Langerak
1,494,236 A 5/1924 Greathouse
1,507,879 A 9/1924 Wright
1,585,049 A 5/1926 Skoglund
1,603,144 A 10/1926 Nichols
1,686,175 A 10/1928 Read
1,812,622 A 6/1931 Costello
2,069,752 A 2/1937 Dorr
2,252,315 A 8/1941 Doree
2,357,980 A 9/1944 Spiro
2,450,250 A 9/1948 Napton
2,452,502 A 10/1948 Tarbox
2,452,649 A 11/1948 Graves
2,487,227 A 11/1949 Eberle
2,592,182 A * 4/1952 Perugia ..... A43B 23/08 36/51
2,619,744 A 12/1952 Mattes
2,693,039 A 11/1954 Balut
2,736,110 A 2/1956 Hardimon
2,746,178 A 5/1956 Miller et al.
2,825,155 A 3/1958 Hines
2,920,402 A 1/1960 Minera
3,039,207 A 6/1962 Lincors
3,146,535 A 9/1964 Owings
3,192,651 A 7/1965 Smith
3,349,505 A 10/1967 Lopez
3,400,474 A 9/1968 Tendler
3,436,842 A 4/1969 Sachs
3,681,860 A 8/1972 Bidegain
4,095,356 A 6/1978 Robran et al.
4,136,468 A 1/1979 Munschy
4,309,832 A 1/1982 Hunt
4,414,761 A 11/1983 Mahood
4,489,509 A 12/1984 Libit
4,559,724 A 12/1985 Norton
4,562,651 A 1/1986 Frederick et al.
4,573,457 A 3/1986 Parks
4,594,798 A 6/1986 Autry et al.
4,599,811 A 7/1986 Rousseau
4,615,126 A 10/1986 Mathews
4,649,656 A 3/1987 Cox et al.
4,665,634 A 5/1987 Diaz
4,776,111 A 10/1988 Crowley
4,944,099 A 7/1990 Davis
4,959,914 A 10/1990 Hilgarth
4,972,613 A 11/1990 Loveder
5,054,216 A 10/1991 Lin
5,090,140 A 2/1992 Sessa
5,127,170 A 7/1992 Messina
5,152,082 A 10/1992 Culpepper
5,181,331 A 1/1993 Berger
5,184,410 A 2/1993 Hamilton
5,279,051 A 1/1994 Whatley
5,282,327 A 2/1994 Ogle
5,341,583 A 8/1994 Hallenbeck
5,345,698 A 9/1994 Billet et al.
5,371,957 A 12/1994 Gaudio
5,467,537 A 11/1995 Aveni et al.
5,481,814 A 1/1996 Spencer
5,557,866 A 9/1996 Prengler
5,570,523 A 11/1996 Lin
5,682,687 A 11/1997 Arai
5,813,144 A 9/1998 Prengler
5,842,292 A 12/1998 Siesel
5,884,420 A 3/1999 Donnadieu
5,983,530 A 11/1999 Chou
5,997,027 A 12/1999 Jungkind
6,000,148 A 12/1999 Cretinon
6,189,239 B1 2/2001 Gasparovic et al.
6,222,313 B1 4/2001 Smith et al.
6,290,559 B1 9/2001 Scott
6,298,582 B1 10/2001 Friton et al.
6,378,230 B1 4/2002 Rotem et al.
6,427,361 B1 8/2002 Chou
6,438,872 B1 8/2002 Chil et al.
6,557,271 B1 5/2003 Weaver, III
6,578,288 B2 6/2003 Bernstein
6,594,921 B2 7/2003 Laio et al.
6,643,954 B2 11/2003 Voswinkel
6,684,533 B1 2/2004 Su
6,718,658 B2 4/2004 Karasawa
6,817,116 B2 11/2004 Chil et al.
6,883,254 B2 4/2005 Miller et al.
6,925,732 B1 8/2005 Clarke
6,938,361 B2 9/2005 Su
6,957,504 B2 10/2005 Morris
6,964,119 B2 11/2005 Weaver et al.
7,055,268 B2 6/2006 Ha
7,059,069 B2 6/2006 Raluy et al.
7,080,468 B2 7/2006 Miller et al.
7,101,604 B1 9/2006 Minges
7,103,994 B2 9/2006 Johnson
7,127,837 B2 10/2006 Ito
7,168,190 B1 1/2007 Gillespie
7,178,270 B2 2/2007 Hurd et al.
7,188,438 B1 3/2007 Bowen
7,225,563 B2 6/2007 Chen et al.
7,256,881 B2 8/2007 Leppard et al.
7,284,341 B2 10/2007 Moseley
7,287,294 B2 10/2007 Miller et al.
7,439,837 B2 10/2008 McDonald
7,448,148 B2 11/2008 Martinez et al.
7,472,495 B2 1/2009 Milbourn
7,581,337 B2 9/2009 Miller et al.
7,607,242 B2 10/2009 Karandonis et al.
7,685,747 B1 * 3/2010 Gasparovic ..... A43B 11/00 36/102
7,694,435 B1 4/2010 Kiser et al.
7,735,244 B1 6/2010 Ameche
7,793,438 B1 9/2010 Busse et al.
7,823,299 B1 11/2010 Brigham
7,900,377 B1 3/2011 Perenich
7,905,033 B1 3/2011 Perenich
7,913,422 B1 3/2011 Perenich
7,975,403 B2 7/2011 Mosher
7,984,571 B2 7/2011 Pellegrini
8,006,410 B2 8/2011 Romboli et al.
8,020,317 B1 9/2011 Sokolowski
D648,512 S 11/2011 Schlageter et al.
8,065,819 B2 11/2011 Kaufman
8,161,669 B2 4/2012 Keating
8,171,657 B1 5/2012 Perenich
8,215,030 B2 7/2012 Bowen et al.
8,225,534 B2 7/2012 Mueller et al.
8,225,535 B2 7/2012 Dillenbeck
8,245,418 B2 8/2012 Paintin et al.
8,245,421 B2 8/2012 Baudouin et al.
8,256,146 B2 9/2012 Loverin
8,276,921 B2 10/2012 Walker
8,365,443 B2 2/2013 Huynh
D680,719 S 4/2013 Dardinski
8,468,721 B2 6/2013 Sokolowski
8,468,723 B2 * 6/2013 Malka-Harari ..... A43B 3/26 36/97
8,499,474 B2 8/2013 Kaufman
8,539,698 B1 9/2013 Woodruff
8,549,774 B2 10/2013 Meschter et al.
8,577,656 B1 11/2013 Teng et al.
8,627,582 B2 1/2014 Perenich
8,627,583 B2 1/2014 Perenich
8,635,791 B2 1/2014 Baudouin et al.
8,656,613 B2 2/2014 Stockbridge et al.
8,745,893 B2 6/2014 Gavrieli et al.
8,756,833 B2 6/2014 Heard
8,763,275 B2 7/2014 Shalom et al.
8,769,845 B2 7/2014 Lin
8,834,770 B2 9/2014 Nakano
8,919,015 B2 12/2014 Holt et al.
9,015,962 B2 4/2015 Boudreau et al.
9,032,646 B2 5/2015 Perenich
9,044,063 B2 6/2015 Loverin et al.
9,061,096 B2 6/2015 Taylor et al.

(56) References Cited

U.S. PATENT DOCUMENTS

| | | | | |
|---|---|---|---|---|
| 9,089,184 | B1 | 7/2015 | Kiser et al. | |
| 9,095,188 | B2 | 8/2015 | Cavaliere | |
| 9,119,436 | B1 | 9/2015 | Ardell et al. | |
| 9,119,437 | B2 | 9/2015 | Weller et al. | |
| 9,144,262 | B2 | 9/2015 | Ardell et al. | |
| 9,144,263 | B2 | 9/2015 | Elder et al. | |
| 9,173,451 | B2 | 11/2015 | Shim | |
| 9,254,018 | B2 | 2/2016 | Bliss | |
| 9,265,305 | B2 * | 2/2016 | Hatfield | A43C 11/14 |
| 9,266,543 | B2 | 2/2016 | Takagi | |
| 9,301,570 | B2 * | 4/2016 | Hwang | A43B 3/26 |
| 9,314,055 | B2 | 4/2016 | Moran | |
| 9,314,067 | B2 | 4/2016 | Bock | |
| 9,363,980 | B2 | 6/2016 | Lander | |
| 9,392,843 | B2 | 7/2016 | Callahan et al. | |
| 9,392,844 | B1 | 7/2016 | Burrell | |
| 9,398,785 | B2 | 7/2016 | Horacek | |
| 9,398,786 | B2 | 7/2016 | Gavrieli et al. | |
| 9,414,640 | B2 | 8/2016 | Nichols | |
| 9,433,256 | B2 | 9/2016 | Callahan et al. | |
| 9,445,644 | B2 | 9/2016 | Cressman et al. | |
| 9,474,330 | B2 | 10/2016 | Panian et al. | |
| 9,480,299 | B2 | 11/2016 | Dinndorf et al. | |
| 9,675,132 | B2 | 6/2017 | Marshall | |
| 9,730,494 | B1 | 8/2017 | Feinstein | |
| 9,820,527 | B2 | 11/2017 | Pratt et al. | |
| 9,839,261 | B2 | 12/2017 | Hatfield et al. | |
| 9,854,875 | B2 | 1/2018 | Hatfield et al. | |
| 9,877,542 | B2 | 1/2018 | Pratt | |
| 9,949,533 | B2 | 4/2018 | Feinstein | |
| 10,159,310 | B2 | 12/2018 | Sullivan | |
| 2002/0144434 | A1 | 10/2002 | Farys et al. | |
| 2002/0174568 | A1 | 11/2002 | Neiley | |
| 2003/0009917 | A1 | 1/2003 | Voswinkel | |
| 2003/0200680 | A1 | 10/2003 | Chang | |
| 2004/0078999 | A1 * | 4/2004 | Freed | A43C 11/008 36/50.1 |
| 2004/0111921 | A1 | 6/2004 | Lenormand | |
| 2005/0039348 | A1 | 2/2005 | Raluy et al. | |
| 2005/0060913 | A1 | 3/2005 | Chil et al. | |
| 2005/0066548 | A1 | 3/2005 | Chil et al. | |
| 2006/0005432 | A1 | 1/2006 | Kassai et al. | |
| 2006/0037215 | A1 | 2/2006 | Lee | |
| 2007/0011917 | A1 | 1/2007 | Hayes | |
| 2007/0039208 | A1 | 2/2007 | Bove et al. | |
| 2007/0074425 | A1 | 4/2007 | Leong | |
| 2007/0186441 | A1 | 8/2007 | Chen | |
| 2007/0199211 | A1 | 8/2007 | Campbell | |
| 2007/0199213 | A1 | 8/2007 | Campbell et al. | |
| 2007/0209234 | A1 | 9/2007 | Chou | |
| 2008/0000106 | A1 | 1/2008 | Culpepper | |
| 2008/0086911 | A1 | 4/2008 | Labbe | |
| 2008/0141562 | A1 | 6/2008 | Peveto | |
| 2008/0307673 | A1 | 12/2008 | Johnson | |
| 2009/0025260 | A1 | 1/2009 | Nakano | |
| 2010/0199522 | A1 * | 8/2010 | Hwang | A43B 23/047 36/102 |
| 2010/0251572 | A1 | 10/2010 | Baudouin et al. | |
| 2010/0319216 | A1 | 12/2010 | Grenzke et al. | |
| 2011/0016751 | A1 | 1/2011 | Somerville | |
| 2011/0146106 | A1 | 6/2011 | Kaufman | |
| 2011/0214312 | A1 | 9/2011 | Krikelis | |
| 2011/0247238 | A1 | 10/2011 | Chestnut | |
| 2011/0254251 | A1 | 10/2011 | Jung | |
| 2012/0023783 | A1 | 2/2012 | Nichols | |
| 2012/0079746 | A1 | 4/2012 | Ferreira et al. | |
| 2012/0204450 | A1 | 8/2012 | Girbaud | |
| 2012/0317839 | A1 | 12/2012 | Pratt | |
| 2013/0185955 | A1 | 7/2013 | Cheng | |
| 2013/0185959 | A1 | 7/2013 | Coleman | |
| 2013/0219747 | A1 | 8/2013 | Lederer | |
| 2014/0000131 | A1 | 1/2014 | Meschter et al. | |
| 2014/0012406 | A1 | 1/2014 | Cioffi et al. | |
| 2014/0013624 | A1 | 1/2014 | Stockbridge et al. | |
| 2014/0096415 | A1 | 4/2014 | Long | |
| 2014/0115925 | A1 | 5/2014 | Hurd et al. | |
| 2014/0250723 | A1 | 9/2014 | Kohatsu | |
| 2014/0298687 | A1 | 10/2014 | Flinterman et al. | |
| 2014/0305005 | A1 | 10/2014 | Yeh | |
| 2014/0310992 | A1 | 10/2014 | Shalom et al. | |
| 2014/0360049 | A1 | 12/2014 | Panian et al. | |
| 2015/0020416 | A1 | 1/2015 | Wiens | |
| 2015/0047223 | A1 | 2/2015 | Flinterman et al. | |
| 2015/0047227 | A1 | 2/2015 | Fallon et al. | |
| 2015/0096197 | A1 | 4/2015 | Salinas | |
| 2015/0113834 | A1 | 4/2015 | Dojan et al. | |
| 2015/0143720 | A1 | 5/2015 | Avar | |
| 2015/0196095 | A1 | 7/2015 | Chapman | |
| 2015/0216252 | A1 * | 8/2015 | Wiens | A43B 1/0054 36/105 |
| 2015/0289595 | A1 | 10/2015 | Rushbrook et al. | |
| 2015/0305432 | A1 | 10/2015 | Wiens | |
| 2015/0305442 | A1 | 10/2015 | Ravindran | |
| 2015/0374065 | A1 | 12/2015 | Difrancisco | |
| 2016/0128429 | A1 | 5/2016 | Hatfield et al. | |
| 2016/0166006 | A1 | 6/2016 | Difrancisco | |
| 2016/0242493 | A1 | 8/2016 | Stillwagon | |
| 2016/0270484 | A1 | 9/2016 | Zadnik | |
| 2016/0302530 | A1 | 10/2016 | Smith et al. | |
| 2016/0374427 | A1 | 12/2016 | Zahabian | |
| 2017/0042290 | A1 | 2/2017 | Hatfield et al. | |
| 2017/0049190 | A1 | 2/2017 | Maussen | |
| 2017/0099906 | A1 | 4/2017 | Figueroa | |
| 2017/0150773 | A1 | 6/2017 | Beers | |
| 2017/0209772 | A1 | 7/2017 | Suda | |
| 2017/0265560 | A1 | 9/2017 | Beers et al. | |
| 2017/0360143 | A1 | 12/2017 | Pratt et al. | |
| 2018/0110287 | A1 | 4/2018 | Hopkins et al. | |
| 2018/0110288 | A1 | 4/2018 | Hatfield et al. | |
| 2018/0110289 | A1 | 4/2018 | Owings et al. | |
| 2018/0110292 | A1 | 4/2018 | Beers et al. | |
| 2018/0206588 | A1 | 7/2018 | Pratt et al. | |
| 2018/0213890 | A1 | 8/2018 | Innocente | |
| 2018/0231882 | A1 | 8/2018 | Miura | |
| 2018/0235314 | A1 | 8/2018 | Farage | |
| 2018/0263332 | A1 | 9/2018 | Bruno | |
| 2018/0295942 | A1 | 10/2018 | Drake | |
| 2019/0000186 | A1 | 1/2019 | Mou et al. | |

FOREIGN PATENT DOCUMENTS

| | | | |
|---|---|---|---|
| CN | 2052208 | U | 2/1990 |
| CN | 2112959 | U | 8/1992 |
| CN | 2161101 | Y | 4/1994 |
| CN | 2262929 | Y | 9/1997 |
| CN | 2268406 | Y | 11/1997 |
| CN | 2275814 | Y | 3/1998 |
| CN | 2281094 | Y | 5/1998 |
| CN | 2384464 | Y | 6/2000 |
| CN | 2456500 | Y | 10/2001 |
| CN | 2482829 | Y | 3/2002 |
| CN | 1403041 | A | 3/2003 |
| CN | 1565297 | A | 1/2005 |
| CN | 2712118 | Y | 7/2005 |
| CN | 2783792 | Y | 5/2006 |
| CN | 2819852 | Y | 9/2006 |
| CN | 2901950 | Y | 5/2007 |
| CN | 201005111 | Y | 1/2008 |
| CN | 201157014 | Y | 12/2008 |
| CN | 201167619 | Y | 12/2008 |
| CN | 101485505 | A | 7/2009 |
| CN | 101518380 | A | 9/2009 |
| CN | 201426430 | Y | 3/2010 |
| CN | 201504620 | U | 6/2010 |
| CN | 201743039 | U | 2/2011 |
| CN | 101986920 | A | 3/2011 |
| CN | 201831038 | U | 5/2011 |
| CN | 201967803 | U | 9/2011 |
| CN | 202211219 | U | 5/2012 |
| CN | 101991227 | B | 8/2012 |
| CN | 202819794 | U | 3/2013 |
| CN | 203121188 | U | 8/2013 |
| CN | 203137220 | U | 8/2013 |
| CN | 203841187 | U | 9/2014 |

(56) References Cited

FOREIGN PATENT DOCUMENTS

| | | | |
|---|---|---|---|
| CN | 203884822 | U | 10/2014 |
| CN | 203913577 | U | 11/2014 |
| CN | 204070772 | U | 1/2015 |
| CN | 205040743 | U | 2/2016 |
| CN | 105876979 | A | 8/2016 |
| CN | 205568021 | U | 9/2016 |
| CN | 205658453 | U | 10/2016 |
| CN | 205671573 | U | 11/2016 |
| CN | 205795015 | U | 12/2016 |
| CN | 206025369 | U | 3/2017 |
| CN | 107692396 | A | 2/2018 |
| CN | 207544444 | U | 6/2018 |
| CN | 207949063 | U | 10/2018 |
| DE | 3310988 | A1 | 9/1984 |
| DE | 19534249 | A1 | 3/1997 |
| DE | 19611797 | A1 | 10/1997 |
| DE | 29809404 | U1 | 8/1998 |
| DE | 10247163 | A1 | 4/2004 |
| DE | 102004005288 | A1 | 8/2005 |
| DE | 102009023689 | A1 | 12/2010 |
| DE | 202016001813 | U1 | 7/2017 |
| EP | 0570621 | A1 | 11/1993 |
| EP | 1059044 | A1 | 12/2000 |
| EP | 1593315 | B1 | 5/2008 |
| EP | 1952715 | A1 | 8/2008 |
| EP | 2173208 | B1 | 12/2010 |
| EP | 2277402 | A2 | 1/2011 |
| EP | 2036449 | B1 | 4/2013 |
| EP | 2818068 | A1 | 12/2014 |
| EP | 2848141 | A1 | 3/2015 |
| EP | 2937007 | A1 | 10/2015 |
| EP | 3167742 | A1 | 5/2017 |
| GB | 1154145 | | 6/1969 |
| GB | 1358470 | | 7/1974 |
| GB | 2517399 | A | 2/2015 |
| GB | 2533809 | A | 7/2016 |
| JP | 1-81910 | U | 6/1989 |
| JP | 2001-149394 | A | 6/2001 |
| JP | 2004-236860 | A | 8/2004 |
| JP | 2008-206629 | A | 9/2008 |
| KR | 10-2013-0119566 | A | 11/2013 |
| NL | 1020208 | C | 9/2003 |
| TW | 585748 | | 5/2004 |
| TW | M275736 | | 9/2005 |
| TW | 200930315 | | 7/2009 |
| TW | 201130440 | A1 | 9/2011 |
| TW | M449484 | U1 | 4/2013 |
| TW | M469778 | U | 1/2014 |
| TW | I582215 | B | 5/2017 |
| WO | 88/08678 | A1 | 11/1988 |
| WO | 92/03943 | A1 | 3/1992 |
| WO | 97/37556 | A1 | 10/1997 |
| WO | 03/039283 | A1 | 5/2003 |
| WO | 2005/070246 | A2 | 8/2005 |
| WO | 2006/084185 | A1 | 8/2006 |
| WO | 2007/024875 | A2 | 3/2007 |
| WO | 2007/080205 | A1 | 7/2007 |
| WO | 2008/115743 | A1 | 9/2008 |
| WO | 2008/152414 | A1 | 12/2008 |
| WO | 2009/154350 | A1 | 12/2009 |
| WO | 2010/048203 | A1 | 4/2010 |
| WO | 2010/059716 | A2 | 5/2010 |
| WO | 2010/114993 | A1 | 10/2010 |
| WO | 2011/004946 | A1 | 1/2011 |
| WO | 2011/140584 | A1 | 11/2011 |
| WO | 2012/044974 | A1 | 4/2012 |
| WO | 2012/168956 | A1 | 12/2012 |
| WO | 2013/039385 | A1 | 3/2013 |
| WO | 2013/187288 | A1 | 12/2013 |
| WO | 2014/033396 | A1 | 3/2014 |
| WO | 2014/038937 | A1 | 3/2014 |
| WO | 2014/140443 | A1 | 9/2014 |
| WO | 2015/002521 | A1 | 1/2015 |
| WO | 2015/198460 | A1 | 12/2015 |
| WO | 2016/005696 | A1 | 1/2016 |
| WO | 2016/015161 | A1 | 2/2016 |
| WO | 2016/196195 | A1 | 12/2016 |
| WO | 2018/092023 | A1 | 5/2018 |
| WO | 2018/193276 | A1 | 10/2018 |

* cited by examiner

INCREASED ACCESS FOOTWEAR

CROSS-REFERENCE TO RELATED APPLICATIONS

This application is a continuation of U.S. application Ser. No. 15/955,386 (filed Apr. 17, 2018), which claims priority to U.S. Provisional Application 62/486,311 (filed Apr. 17, 2017). The entirety of each of the aforementioned applications is incorporated by reference herein.

TECHNICAL FIELD

Article of footwear structures allowing easier access to a foot-receiving cavity.

BACKGROUND

Shoes generally provide access to a foot-receiving cavity through an ankle opening and a forefoot opening. The forefoot opening may be adjusted with a lacing mechanism in a traditional shoe. In order to gain access to the foot-receiving cavity, the laces may be loosened and a wearer then attempts to insert his/her foot through the ankle opening and then adjust an insertion angle of the foot to move the foot forward into the foot-receiving cavity. However, some wearer's may have limited mobility, dexterity, flexibility, and/or access that makes donning and/or doffing a traditionally-structured shoe difficult.

BRIEF SUMMARY

An article of footwear providing easy donning and doffing through a heel region is provided. A heel cup at a heel end of the footwear is pivotably coupled with the footwear to articulate between an open configuration allowing easier access to a foot-receiving cavity and a closed configuration enclosing a heel region of the footwear. A tensioning strap extends from a first side of the footwear around the heel cup to an opposite, second side of the footwear when the heel cup is in the closed configuration. The tensioning strap is effective to structurally secure the heel cup in the closed configuration. One or more tensioning strands may extend from the tensioning strap. The tensioning strands may be effective to convert force provided through the tensioning strap across a forefoot portion to generate a forefoot securing force through a lacing mechanism. This summary is provided to enlighten and not limit the scope of methods and systems provided hereafter in complete detail.

DESCRIPTION OF THE DRAWINGS

The present invention is described in detail herein with reference to the attached drawing figures, wherein.

DETAILED DESCRIPTION

Figure 1:
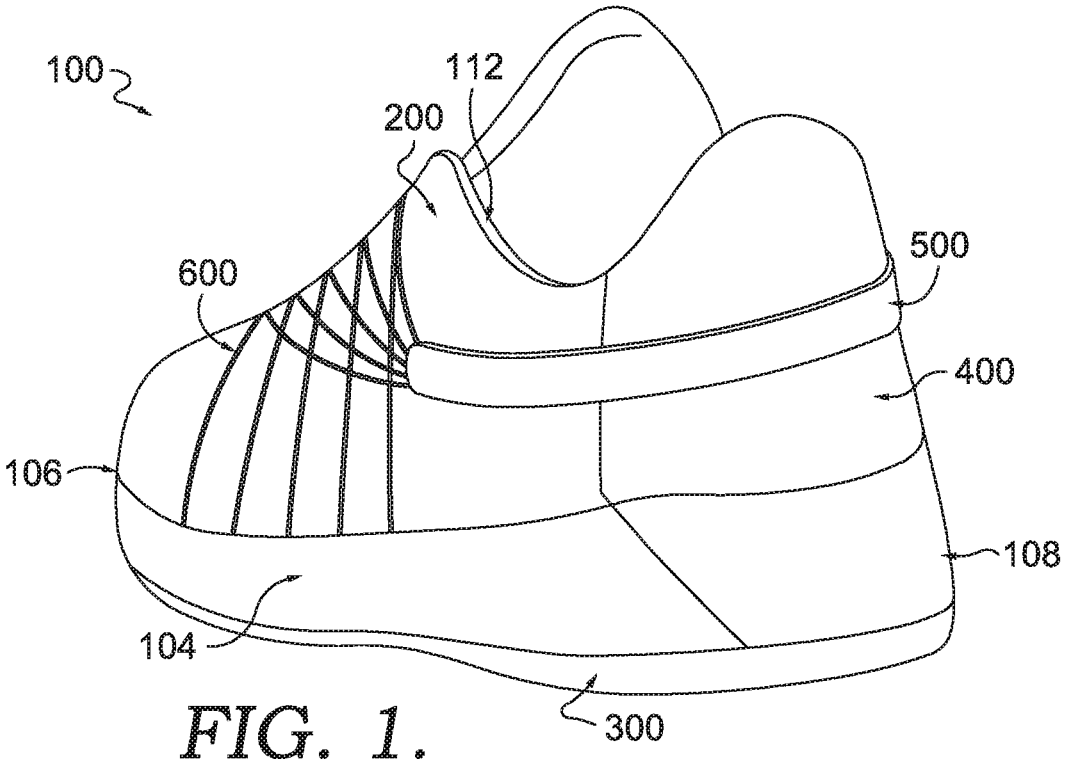
FIG. 1 depicts a heel perspective view of an article of footwear in a closed configuration, in accordance with aspects hereof.

An article of footwear (hereinafter "shoe"), such as an athletic shoe, is generally secured to a wearer's foot to allow for a functional connection between the shoe and the wearer. To assist in the donning and doffing of the shoe, lacing or other adjustable securing mechanisms may be implemented to allow easier access to an internal foot-receiving cavity of the shoe. In a traditional athletic shoe, a lacing structure is loosened to increase a forefoot opening to allow a foot to slide through an ankle opening and into the internal foot-receiving cavity. Once the foot has been positioned within the foot-receiving cavity, the lacing structure is tightened to secure the shoe about the foot.

Some wearers of a shoe may have limited mobility, dexterity, motion, or other non-traditional characteristics that may hinder or hamper the ability of the wearer to don or doff the shoe using a traditional configuration. For example, wearers with prosthetics, non-traditional anatomy, or other limitations may have a difficult time putting on, securing, and/or taking off a traditional shoe. However, these same wearers of shoes may desire to have a traditional appearance or functionality of their shoe while also having enhanced donning and doffing characteristics. As such, aspects hereof contemplate a shoe having an articulated heel cup allowing for easy donning and doffing while also having a tensioning strap to secure the articulated heel cup in an intended location during activity when worn by the wearer.

An articulated heel cup, as will be discussed in greater detail herein, provides an enhanced access to the internal foot receiving cavity of the shoe. In a traditional shoe, a heel counter or heel portion prevents a toeward entry through a heel end of a traditional athletic-style shoe. Instead, a wearer enters the internal foot-receiving cavity from an ankle collar opening with a downward and forward motion of the foot. This traditional motion may be difficult or impossible for some wearers. Therefore, a linear entry from a heel end as the heel cup is articulated downward into an open configuration provides for a simplified access to the internal foot-receiving cavity, as will be discussed hereinafter.

Aspects generally contemplate an article of footwear that provides easy donning and doffing through a heel region. A heel cup is pivotably coupled with the footwear to articulate between an open configuration allowing easier access to a foot-receiving cavity and a closed configuration enclosing a heel region of the footwear. A tensioning strap extends from a first side of the footwear around the heel cup to an opposite second side of the footwear when the heel cup is in the closed configuration. The tensioning strap is effective to structurally secure the heel cup in the closed configuration. One or more tensioning strands may extend from the tensioning strap. The tensioning strands may be effective to convert force provided through the tensioning strap across a forefoot portion to generate a forefoot securing force through a lacing mechanism.

Figure 2:
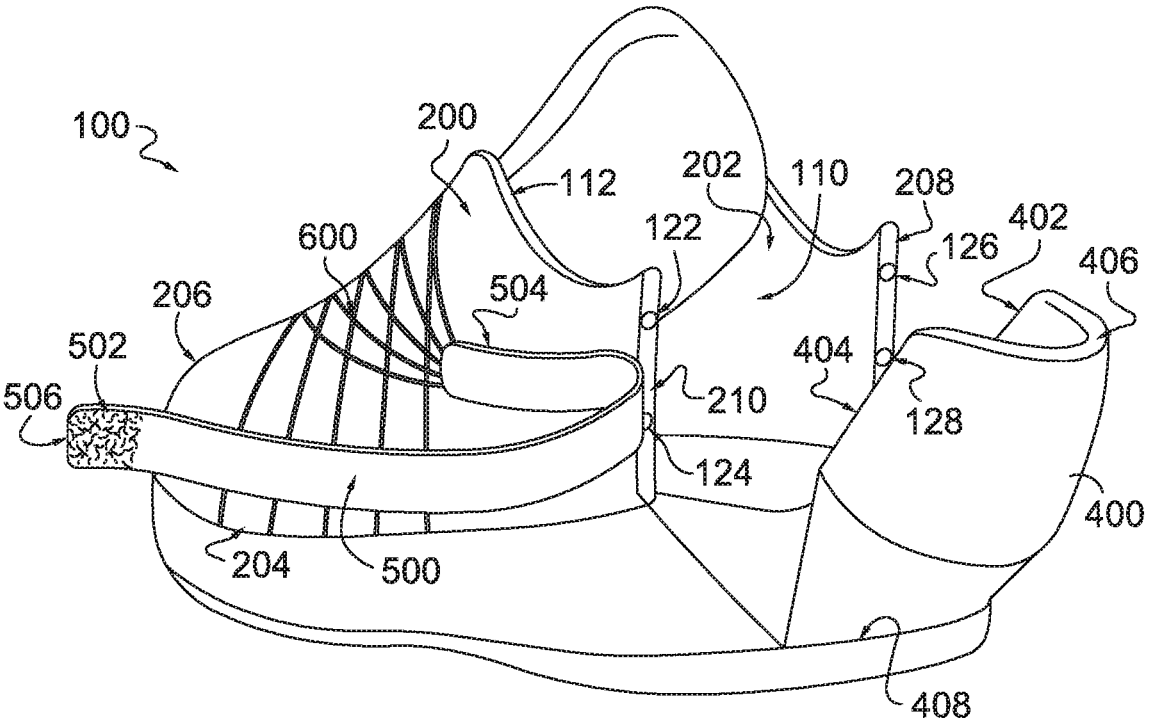
FIG. 2 depicts a heel perspective view of the article of footwear of FIG. 1 in an open configuration, in accordance with aspects hereof.

Aspects hereof depicted in the figures contemplate an article of footwear 100 having a medial side 102 (shown in FIG. 9), a lateral side 104, a toe end 106, and a heel end 108. The article of footwear 100 is also comprised of an upper 200 having a medial side 202 (shown in FIG. 2), a lateral side 204, and a toe end 206 extending between the medial side 202 and the lateral side 204. The upper 200 further comprising a medial heel edge 208 and a lateral heel edge 210 (shown in FIG. 2). The medial heel edge 208 and the lateral heel edge 210 are opposite from the toe end 106 in a longitudinal direction 212 (shown in FIG. 7) of the article of footwear 100. The article of footwear 100 also comprises a sole 300 having a medial side 302, a lateral side 304, a toe end 306, and a heel end 308 (shown in FIGS. 7 and 9). As seen in FIG. 2, the article of footwear 100 also comprises a heel cup 400 articulated at the heel end 108 of the article of footwear 100, the heel cup 400 having a medial edge 402, a lateral edge 404, a collar edge 406, and a hinge edge 408. The heel cup 400 articulates between an open configuration that exposes an interior foot-receiving cavity 110 of the article of footwear 100 and a closed configuration that encloses a heel-end portion of the interior foot-receiving cavity 110. The article of footwear 100 also comprises a tensioning strap 500 extending from the article of footwear medial side 102 to the article of footwear lateral side 104 around the heel cup 400 when the heel cup 400 is in the closed configuration. The tensioning strap 500 is releasably secured at one of the article of footwear medial side 102 or the article of footwear lateral side 104.

Additional aspects contemplate a first plurality of tensioning strands 600 joined with the tensioning strap 500. In this example, the tensioning strands 600 effectively transfer a tension force from the tensioning strap 500 in a manner that further secures the article of footwear 100 to the foot of a wearer. For example, the tensioning straps may translate a tension force across a forefoot portion of the article of footwear 100 (e.g., across a traditional tongue region) in a manner to replicate a traditional shoe lace tightening operation. Other aspects contemplate inclusion of one or more magnetic elements (i.e., materials having a magnetic energy and/or attracted to magnetic energy, such as a ferrous material) in the article of footwear 100. The magnetic elements may be included in the heel cup 400 and/or the upper 200 to aid in the alignment and/or closure of the foot-receiving cavity through articulation of the heel cup 400 to a closed position, as will be discussed in greater detail hereinafter.

A listing of elements identified in FIGS. 1-12 is reproduced below for convenience.

Figure 7:
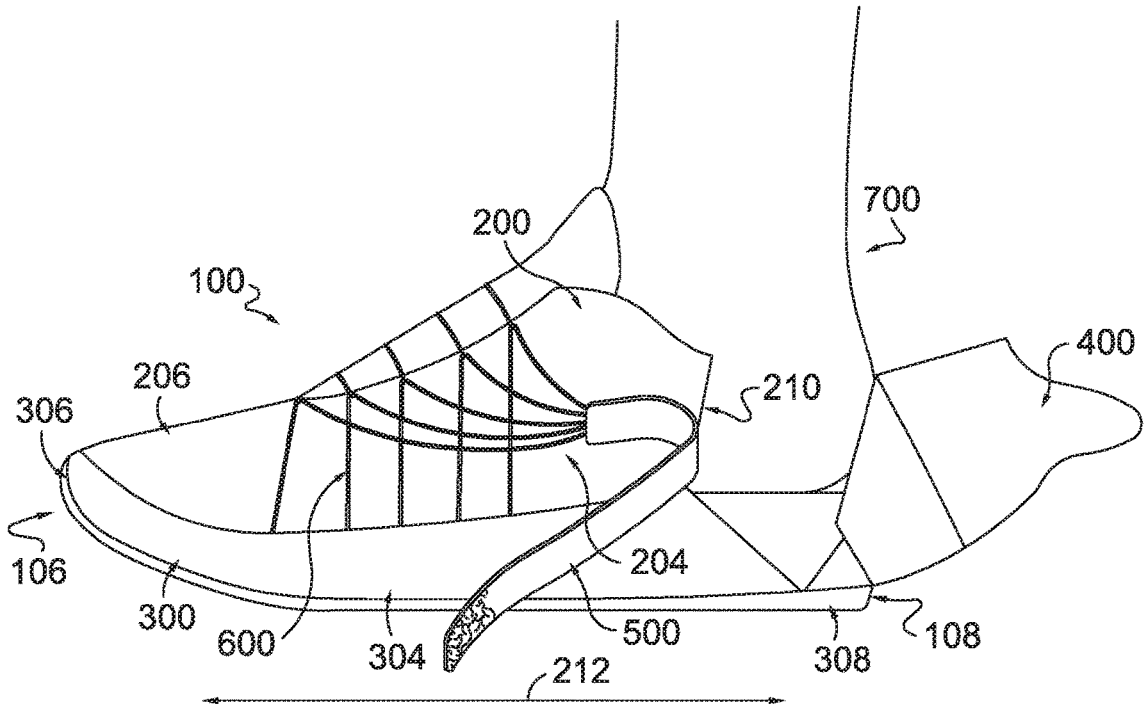
FIG. 7 depicts a lateral side view of the article of footwear of FIG. 6 in an open configuration with the foot positioned in the foot-receiving cavity, in accordance with aspects hereof.

100—article of footwear
102—medial side
104—lateral side
106—toe end
108—heel end
110—interior foot-receiving cavity
112—ankle collar
114—vamp
116—forefoot
118—tongue
120—biteline
122—magnetic element
123—magnetic element
124—magnetic element
125—magnetic element
126—magnetic element
128—magnetic element
130—forefoot lacing element
200—upper
202—medial side
204—lateral side
206—toe end
208—medial heel edge
210—lateral heel edge
212—longitudinal direction
300—sole
302—medial side
304—lateral side
306—toe end
308—heel end
400—heel cup
402—medial edge
404—lateral edge
406—collar edge
408—hinge edge
500—strap
502—first end
504—second end
506—releasable securing mechanism
600—tensioning strand
602—first portion
604—second portion
606—intermediate portion
608—non-linear segment
610—fixed coupling
612—second end
614—first end
620—second tensioning strand FIGS. 1-4 depict a sequence of donning the article of footwear 100 from a heel perspective view, in accordance with aspects hereof. As previously mentioned, an article of footwear may be any footwear article, such as a shoe. The shoe may be a dress shoe, a moccasin, an athletic shoe, a leisure shoe, and the like. Depicted herein for illustration purposes is a basketball or running-style shoe. However, it is contemplated that any style of shoe may be implemented. In an exemplary aspect, the shoe has a heel portion, such as a heel portion having a heel counter, that, when closed, prevents a linear entry in the longitudinal direction 212 (as seen in FIG. 7) (e.g., in a heel-to-toe direction) of the shoe into the shoe's foot-receiving cavity. Therefore, concepts contemplated include pivoting, tilting, swinging, or otherwise articulating a heel cup portion to expose the shoe's internal foot-receiving cavity for easy donning and doffing through a linear entry in the longitudinal direction 212.

FIG. 1 depicts the article of footwear 100 in a closed configuration, in accordance with aspects hereof. The heel cup 400 is secured by the tensioning strap 500 to the upper 200. This closed configuration refers to enclosing the interior foot-receiving cavity 110 of the article of footwear 100 in an as-worn configuration. The ankle collar 112 continues to provide an opening for the user's ankle/leg to access the interior foot-receiving cavity 110 while in the closed configuration of FIG. 1.

The upper 200 may be formed from any material suitable for an article of footwear. For example the upper 200 may be a knit, woven, non-woven, or braided material. The upper 200 may be formed from a leather, polymer-based, or other material. Different portions of the upper 200 may be formed from different materials and/or from different techniques.

The sole 300 forms a ground-contacting surface for the article of footwear 100. A sole, such as the sole 300, may be comprised of a midsole and an outsole. Alternatively, a sole may be a unitary material without discrete midsole and outsole portions. The sole 300 may be formed from any material traditionally used in articles of footwear, such as ethylene-vinyl acetate (EVA), rubber, polypropylene, leather, and the like. In traditional footwear, the upper and the sole are joined to enclose a foot-receiving cavity while providing a ground-contacting surface.

The heel cup 400 articulates (e.g., bends, pivots, flexes, hinges, swings) to allow greater access to the foot-receiving cavity. While the figures provided herein contemplate a longitudinal articulation, aspects herein also contemplate a lateral motion path (e.g., medial-to-lateral or lateral-to-medial articulation). As such, the heel cup is moveably secured (e.g., resilient material forming a living hinge, a mechanical hinge, or the like) to the article of footwear 100. The heel cup 400 may be moveably secured to the upper 200 and/or the sole 300. The heel cup 400 may be formed from any materials, such as those materials contemplated for the upper 200 and/or the sole 300. In an exemplary aspect, the upper 200 and the heel cup 400 are formed from a common material. In an alternative aspect the upper 200 and the heel cup 400 are formed from different materials in whole or in part. The heel cup 400 may comprise one or more elements traditionally incorporated in a shoe upper heel end, such as a heel counter.

The plurality of tensioning strands 600 disperse tension force applied through the tensioning strap 500. The tensioning strands 600 may also translate tensioning force from the tensioning strap 500 into a forefoot securing force, as will be discussed in greater detail hereinafter. Further yet, it is contemplated that the plurality of tensioning strands 600 may be secured on a first end 614 to the article of footwear 100, such as at the sole 300, the upper 200, and/or at an intersection between the sole 300 and the upper 200. As secured, the first end 614 may serve as an anchor from which the tensioning strap 500 can generate a securing force on the heel cup 400 in a closed position.

The plurality of tensioning strands 600 may be formed from a non-elastic material in a first example or from an elastic material in a second example. For example, when the article of footwear is intended to be used in an activity that will generate lateral and/or longitudinal forces, a non-elastic (e.g., a relatively high modulus of elasticity) material may form the plurality of tensioning strands 600 to secure the article of footwear to the wearer's foot. Where comfort or low generated forces are expected, the plurality of tensioning strands 600 may be formed from an elastic material (e.g., a relatively low modulus of elasticity). The elastic modulus may be relative to other materials of the article of footwear, such as the tensioning strap 500, the forefoot lacing mechanism 130, or even the upper 200. The plurality of tensioning strands 600 may be formed from any materials, such as a polymer based material (e.g., polyester, nylon), and organic material (e.g., cotton, wool, leather), aramid, and the like. The tensioning strands may be twisted, braided, or otherwise mechanically manipulated.

While the plurality of tensioning strands 600 are depicted in a specific configuration (e.g., a vertical portion converting into a non-linear segment proximate at the forefoot to a linear segment extending to the tensioning strap 500), it is understood that any arrangement may be implemented. Further, it is contemplated that in some aspects the plurality of tensioning strands 600 may be omitted altogether and the tensioning strap 500 is directly coupled to the article of footwear 100. Further, while discussed in the context of a "plurality" of tensioning strands, it is also contemplated that a single tensioning strand may extend from the tensioning strap 500, in an exemplary aspect. Further yet, it is contemplated that one or more elastic elements (e.g., relatively low modulus of elasticity compared to the tensioning strap 500 and/or the tensioning strand) may be integrated into the tensioning strap 500 and/or the plurality of tensioning strands 600. The integrated elastic elements may provide an initial tensioning force prior to when the in-elastic strap and/or tensioning strands are engaged. This concept may provide for control and comfort of tension forces in an exemplary aspect.

It is contemplated that the tensioning strap 500 is a ribbon-like structure having a width that is at least ten times a thickness. Thus, in some aspects the ribbon-like structure comprises a thin panel of material where the length of the panel is substantially longer than the width of the panel and the width of the panel is substantially wider than the thickness of the panel. The ribbon configuration is effective to distribute tension force across a sufficient portion of the heel cup 400 while in a closed configuration. Each strand of the plurality of tensioning strands 600 are contemplated to have a cross sectional area less than 2 millimeters (mm), such as a circular cross-section with a diameter less than 1.59 mm. In this example, the plurality of tensioning strands 600 are effective to slidably engage one or more lacing mechanisms (such as an element of forefoot lacing mechanism 130) while effectively transferring a tension load across a side of a shoe. Therefore, in combination, the tensioning strap 500 effectively engages the heel cup 400 and the plurality of tensioning strands 600 effectively transfer tension across a side of the shoe (e.g., the article of footwear 100), in an exemplary aspect. Alternative sizes and configurations for the tensioning strap 500 and the plurality of tensioning strands 600 are contemplated.

FIG. 2 depicts the article of footwear 100 having the heel cup 400 in an open configuration, in accordance with aspects hereof. The heel cup 400 in an open configuration may deflect from the closed position by at least 30 degrees, 40 degrees, 50 degrees, 60 degrees, 70 degrees, 80 degrees, 90 degrees, and/or more than 90 degrees. The medial heel edge 208 and the lateral heel edge 210 are exposed on the upper 200. The exposure provides visual access to the magnetic elements 122, 124, 126, and 128. As previously introduced, the magnetic elements 122, 124, 126, and 128 may be magnetic and/or attracted to magnetic forces (e.g., ferrous materials). While depicted in a specific configuration, it is contemplated that the configuration of the magnetic elements 122, 124, 126, and 128 shown in FIG. 2 is not limiting. Instead, magnetic elements may be at any location and in any configuration. For example, instead of discrete circular magnetic elements, instead one or more strips of magnetic elements may be present. Further, while the magnetic elements are depicted in the upper 200, it is contemplated that one or more magnetic elements may alternatively or additionally be located in the sole 300. It is contemplated that complementary magnetic elements are also positioned in the heel cup 400. For example, the heel cup 400 may comprise one or more magnetic elements 123 and 125 (see FIG. 10) (along with other magnetic elements not shown) that in combination with the magnetic elements 122, 124, 126, and 128 of the upper 200 generate a magnetic attraction that aids in aligning and/or securing the heel cup 400 to the upper 200 in a closed configuration. As one example, magnetic elements 123 and 125 align with, and are attracted to, magnetic elements 126 and 122, respectively.

The heel cup 400 is depicted as articulating along the sole 300 at the hinge edge 408 as best seen in FIG. 2. For example, the heel cup 400 may be fixedly secured (e.g., stitched, welded, adhered) to the sole 300 along at least a portion of the hinge edge 408. The heel cup 400 may not be secured permanently to the sole 300 or the upper 200 along the medial edge 402 or the lateral edge 404 other than proximate the hinge edge 408. The limited permanent connection allows for the heel cup 400 to articulate between the open configuration (seen in FIG. 2) and the closed configuration (seen in FIG. 1) in a repeatable manner, in an exemplary aspect.

Referring to FIGS. 1 and 2 in combination, when in the closed configuration, the lateral heel edge 210 of the upper 200 mates with the lateral edge 404 of the heel cup 400 and the medial heel edge 208 of the upper 200 mates with the medial edge 402 of the heel cup 400. Similarly, the collar edge 406 completes the ankle collar 112 formed by the upper 200, when the heel cup is in the closed configuration.

Returning to FIG. 2, the tensioning strap 500 has a first end 502 and a second end 504. In the illustrated aspect, the second end 504 is joined with the plurality of tensioning strands 600. The second end 504 may alternatively or additionally be releasably engageable with the article of footwear 100. For example, tensioning strap 500 may comprise a fastening mechanism 506 at the first end 502, such as a portion of hook-and-loop material, a snap, a clip, a hook, a loop, and the like. The fastening mechanism 506 of the first end 502 may be secured, when the heel cup 400 is in a closed configuration, to the article of footwear on an opposite side (e.g., medial side 102) from the second end 504, in an exemplary aspect. The fastening mechanism 506 may be located in a portion of the tensioning strap 500 other than the first end 502 additionally or alternatively. For example, a fastening mechanism may be positioned in a region overlaying (e.g., extending around an exterior surface) the heel cup 400 when in a closed configuration. Alternative securing means are also contemplated for the tensioning strap 500. For example, the tensioning strap 500 may be secured to the sole 300, the upper 200, the heel cup 400 or any combination in a permanent or releasable manner.

Figure 3:
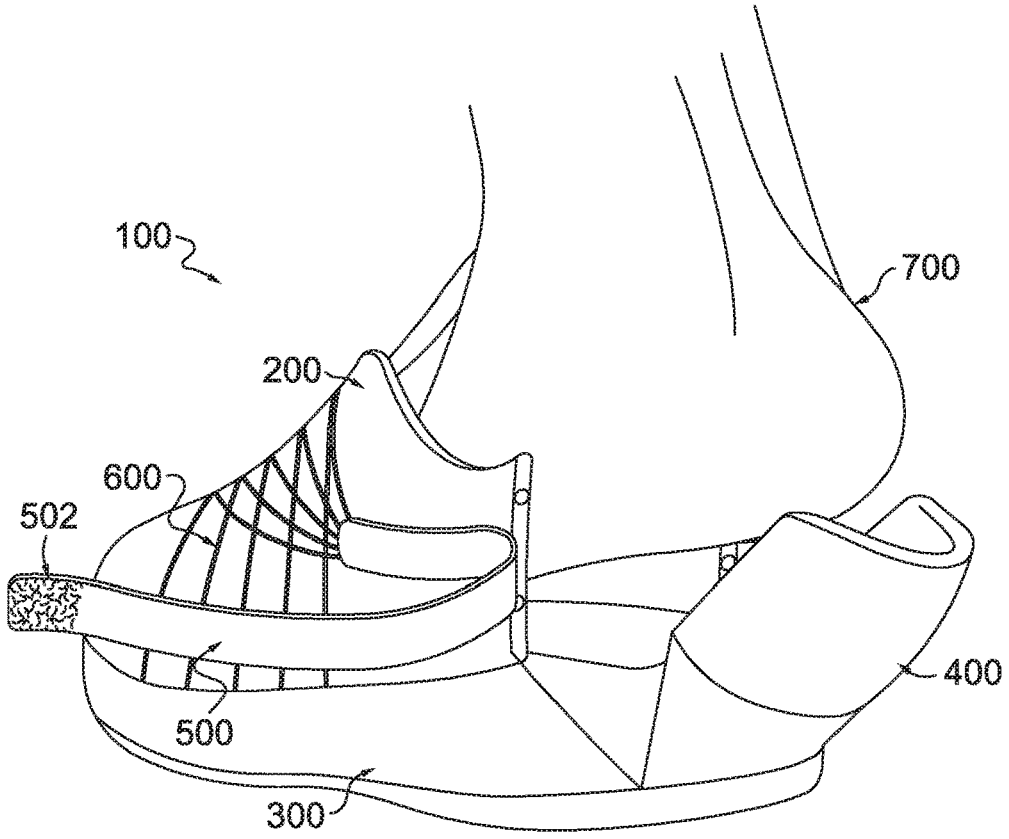
FIG. 3 depicts a heel perspective view of the article of footwear of FIG. 1 in an open configuration receiving a wearer's foot, in accordance with aspects hereof.
Figure 4:
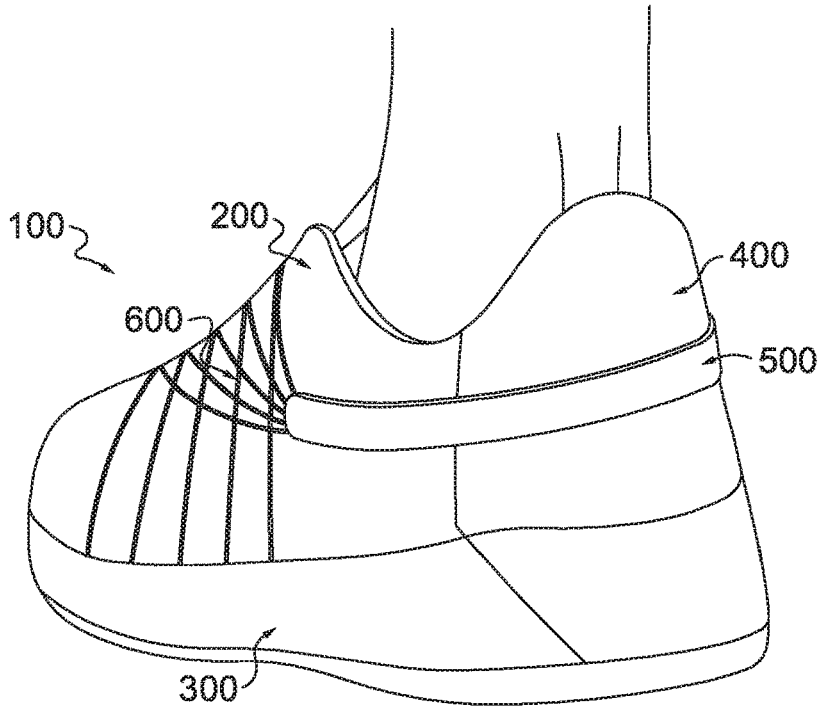
FIG. 4 depicts a heel perspective view of the article of footwear of FIG. 3 in a closed configuration securing a wearer's foot, in accordance with aspects hereof.

FIG. 3 depicts a wearer's foot 700 entering the interior foot-receiving cavity 110 while the article of footwear 100 is in the open configuration, in accordance with aspects hereof. FIG. 4 depicts the article of footwear 100 in the closed configuration while securing the wearer's foot. In this example, the tensioning strap 500 extends around the heel cup 400 to supply a securing force maintaining the heel cup 400 in contact with the upper 200. The tension of the tensioning strap 500 may be translated through the plurality of tensioning strands 600 to also generate a forefoot securing force across a forefoot portion of the article of footwear 100.

Figure 5:
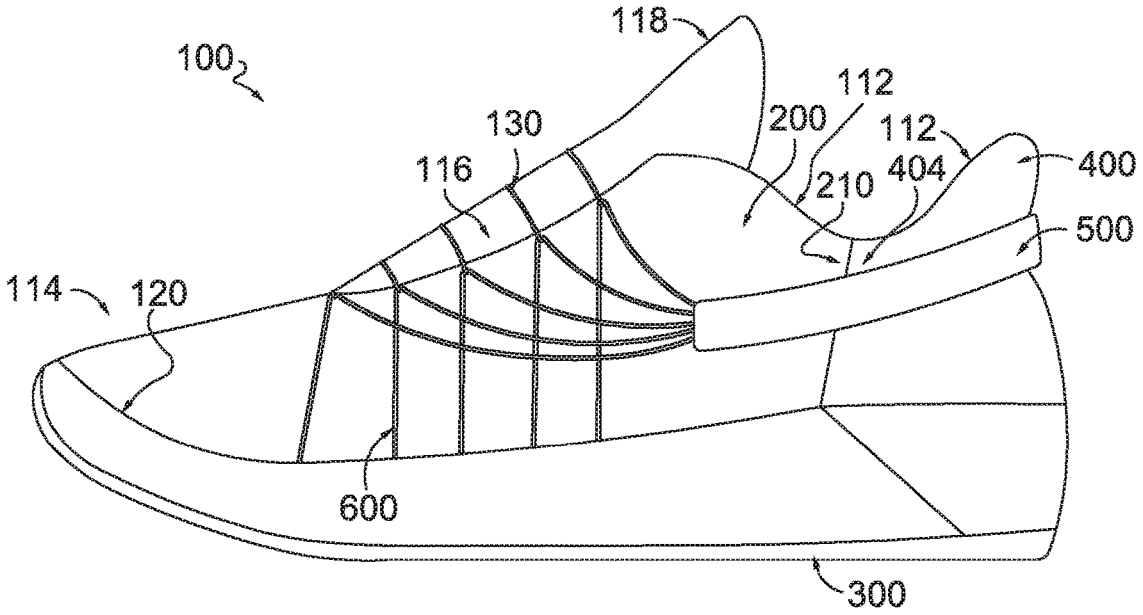
FIG. 5 depicts a lateral side view of the article of footwear of FIG. 1 in a closed configuration, in accordance with aspects hereof.

FIG. 5 depicts a lateral side view of the article of footwear 100 in a closed configuration, in accordance with aspects hereof. The vamp 114 is depicted as extending across a toe region of the article of footwear 100 between the medial side 102 and the lateral side 104. Also depicted is the biteline 120. The biteline 120 defines an intersection between the sole 300 and the upper 200. In an exemplary aspect, one or more of the plurality of tensioning strands 600 are coupled with the article of footwear 100 at the biteline 120. For example, ends or portions of the plurality of tensioning strands 600 may be adhered, welded, and/or stitched with the upper 200 and/or sole 300 prior to joining (e.g., sometimes referred to as bottoming) the two portions. This allows for the joined portions of the plurality of tensioning strands 600 to be concealed and integrated by the article of footwear as a result of the bottoming process.

As seen in FIG. 5, the forefoot lacing mechanism 130 is depicted spanning the forefoot portion 116 between the medial side 102 and the lateral side 104 and cushioned by the tongue 118, in this exemplary aspect. As discussed herein, aspects contemplate the plurality of tensioning strands 600 passing through the forefoot lacing mechanism 130 allowing for tension from the tensioning strands to be converted to a securing force across the forefoot portion 116. For example, it is contemplated that the forefoot lacing mechanism 130 is comprised of an opening, loop, hook, or other element that allows for one or more of the plurality of tensioning strands 600 to slidably engage with the forefoot lacing mechanism 130 such that one or more of the plurality of tensioning strands 600 may pass through the opening, loop, hook, or other element of the forefoot lacing mechanism 130 allowing for a force direction change, as will be discussed in greater detail at FIGS. 6 and 12.

Figure 6:
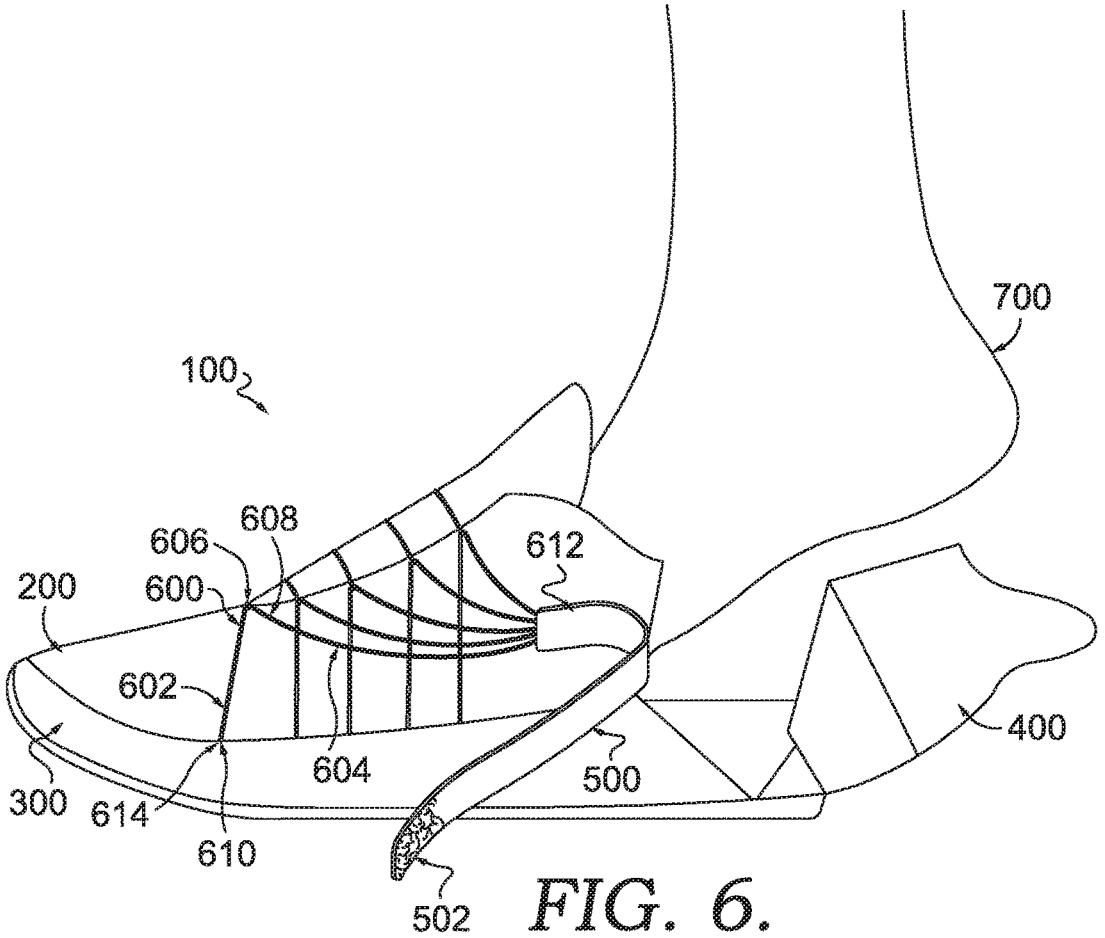
FIG. 6 depicts a lateral side view of the article of footwear of FIG. 1 in an open configuration receiving a foot, in accordance with aspects hereof.

FIG. 6 depicts the article of footwear 100 in the open configuration with a wearer's foot 700 entering the interior foot-receiving cavity 110, in accordance with aspects hereof. Also depicted are detailed portions of one of the tensioning strands from the plurality of tensioning strands 600 (an "example strand"). The example strand includes a first end 614 opposite a second end 612, a first portion 602 extending from the first end 614, a second portion 604 extending from the second end 612, and an intermediate portion 606 between the first portion 602 and the second portion 604. The intermediate portion 606 of the example strand comprises a non-linear segment where the example strand interacts with the forefoot lacing mechanism 130 and tension force is translated in an alternative direction. The second end 612 is joined with the tensioning strap 500 and the first end 614 is secured to the article of footwear 100 at a fixed coupling point 610. As such, as tension is applied from the tensioning strap 500, the force is transferred through the second portion 604 of the example strand to the intermediate portion 606 where the force is divided between the forefoot lacing mechanism 130 and the first portion 602 of the example strand. The force carried by the first portion 602 of the example strand is directed in a different direction toward the fixed coupling point 610. As depicted, a similar arrangement is provided for each of the tensioning strands of the plurality of tensioning strands 600. However, it is also contemplated that alternative configurations may be implemented.

Figure 8:
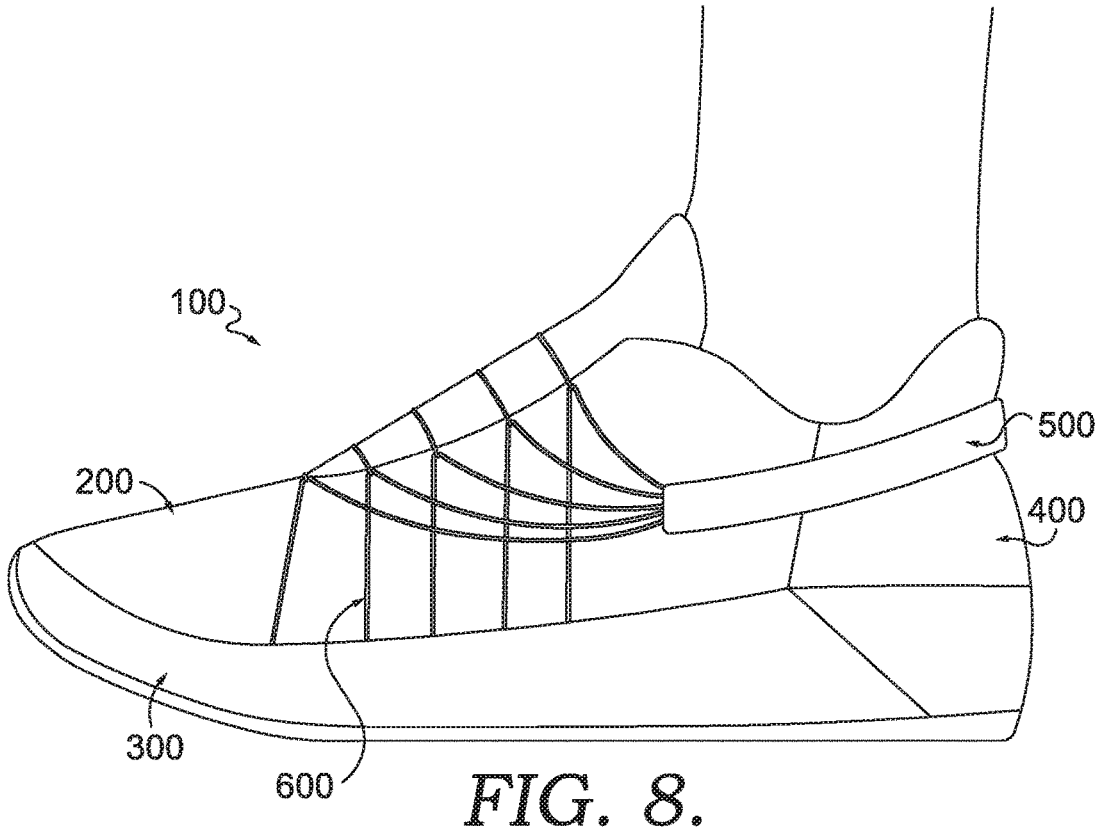
FIG. 8 depicts a lateral side view of the article of footwear of FIG. 7 in the closed configuration securing a foot, in accordance with aspects hereof.

FIG. 7 depicts a lateral side view of the article of footwear 100 in the open configuration and having a wearer's foot 700 completely inserted into the interior foot-receiving cavity 110, in accordance with aspects hereof. The longitudinal direction 212 is depicted between the toe end 106 and the heel end 108. FIG. 8 depicts a lateral side view of the article of footwear 100 in a closed configuration having a foot secured therein, in accordance with aspects hereof.

Referring now to FIGS. 1-4 and 5-8, one aspect of donning the article of footwear 100 will now be described.

As seen in FIGS. 1 and 5, the heel cup 400 is in the closed configuration and the tensioning strap 500 is secured to the upper 200 and around the heel cup 400. To begin donning the illustrated article of footwear 100, the secured first end 502 (seen in FIG. 2) of the tensioning strap 500 is released from the upper 200 by releasing the releasable securing mechanism 506. Next, the heel cup 400 is pulled rearwardly to separate the heel cup 400 from the upper 200. In the illustrated aspect, the heel cup 400 hinges along hinge edge 408 after enough force is applied to overcome the magnetic attraction force between the magnetic elements 122, 124, 126, and 128 in the upper 200 and the magnetic elements in the heel cup 400 (not shown). After the tensioning strap 500 has been released and the heel cup 400 has been pivoted rearwardly, the article of footwear100 is in the open configuration illustrated in FIGS. 2 and 6. Now a wearer's foot 700 may be inserted into the interior foot-receiving cavity 110 of the article of footwear 100, as shown in FIGS. 3, 6 and 7.

Once the wearer's foot 700 is fully received in the interior foot-receiving cavity 110 (as best seen in FIG. 7), the article of footwear 100 may be moved back to the closed configuration. Initially, the heel cup 400 is pivoted back towards the upper 200. The magnetic elements 122, 124, 126, and 128 in the upper 200 and the magnetic elements in the heel cup 400 (not shown) may help align the medial heel edge 208 and the lateral heel edge 210 of the upper 200 with the medial edge 402 and the lateral edge 404 of the heel cup 400. In addition, the magnetic elements 122, 124, 126, and 128 in the upper 200 and the magnetic elements in the heel cup 400 (not shown) may help propel the heel cup 400 towards the upper 200. After the heel cup 400 is pivoted back to the closed configuration and held in such position by the magnetic elements 122, 124, 126, and 128 in the upper 200 and the magnetic elements in the heel cup 400 (not shown), the first end 502 (seen in FIG. 2) of the tensioning strap 500 is secured to the upper 200. As seen in FIGS. 4 and 8, the tensioning strap 500 pulls tension through the plurality of tensioning strands 600 to secure the article of footwear 100 to the wearer's foot 700.

Figure 9:
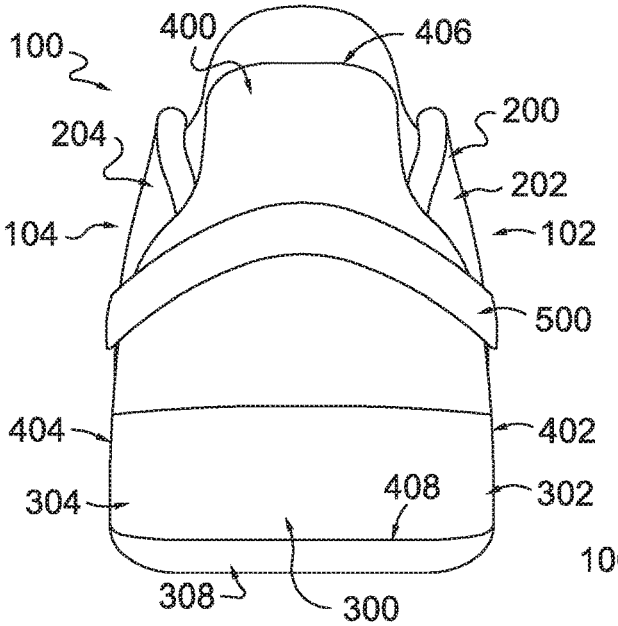
FIG. 9 depicts a heel-end view of the article of footwear of FIG. 1 in the closed configuration, in accordance with aspects hereof.
Figure 10:
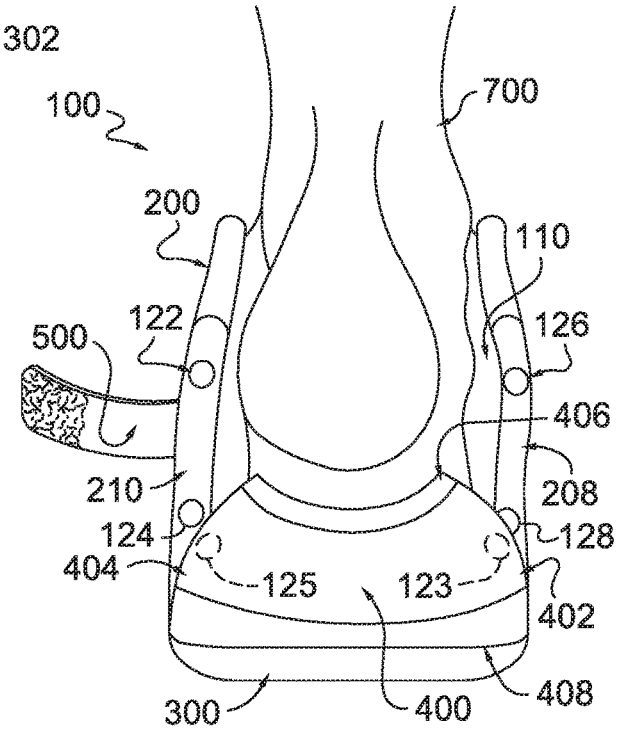
FIG. 10 depicts a heel-end view of the article of footwear of FIG. 1 in the open configuration, in accordance with aspects hereof.
Figure 11:
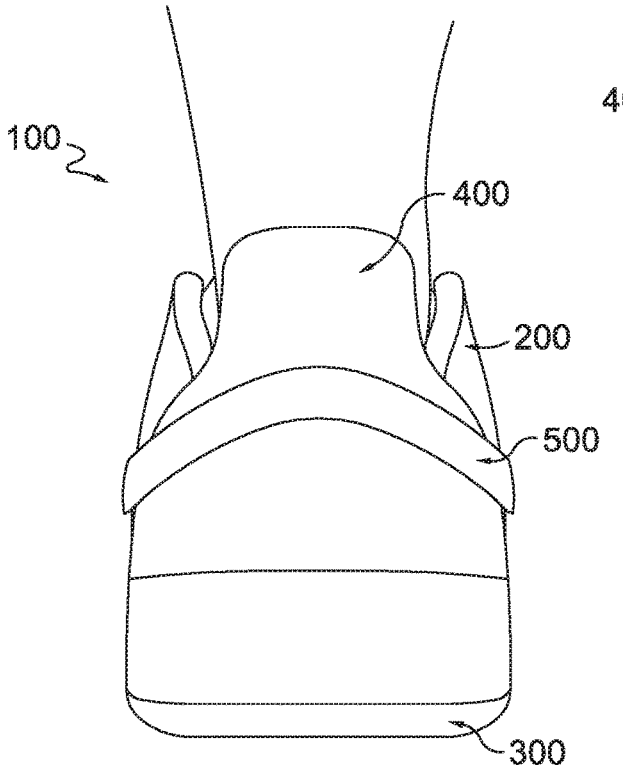
FIG. 11 depicts a heel-end view of the article of footwear of FIG. 1 in the closed configuration securing a foot, in accordance with aspects hereof.

FIGS. 9-11 depict a heel-end view of the article of footwear progressing through a closed configuration in FIG. 9, to an open configuration receiving a foot in FIG. 10, to a closed configuration securing the foot in FIG. 11, in accordance with aspects hereof.

Figure 12:
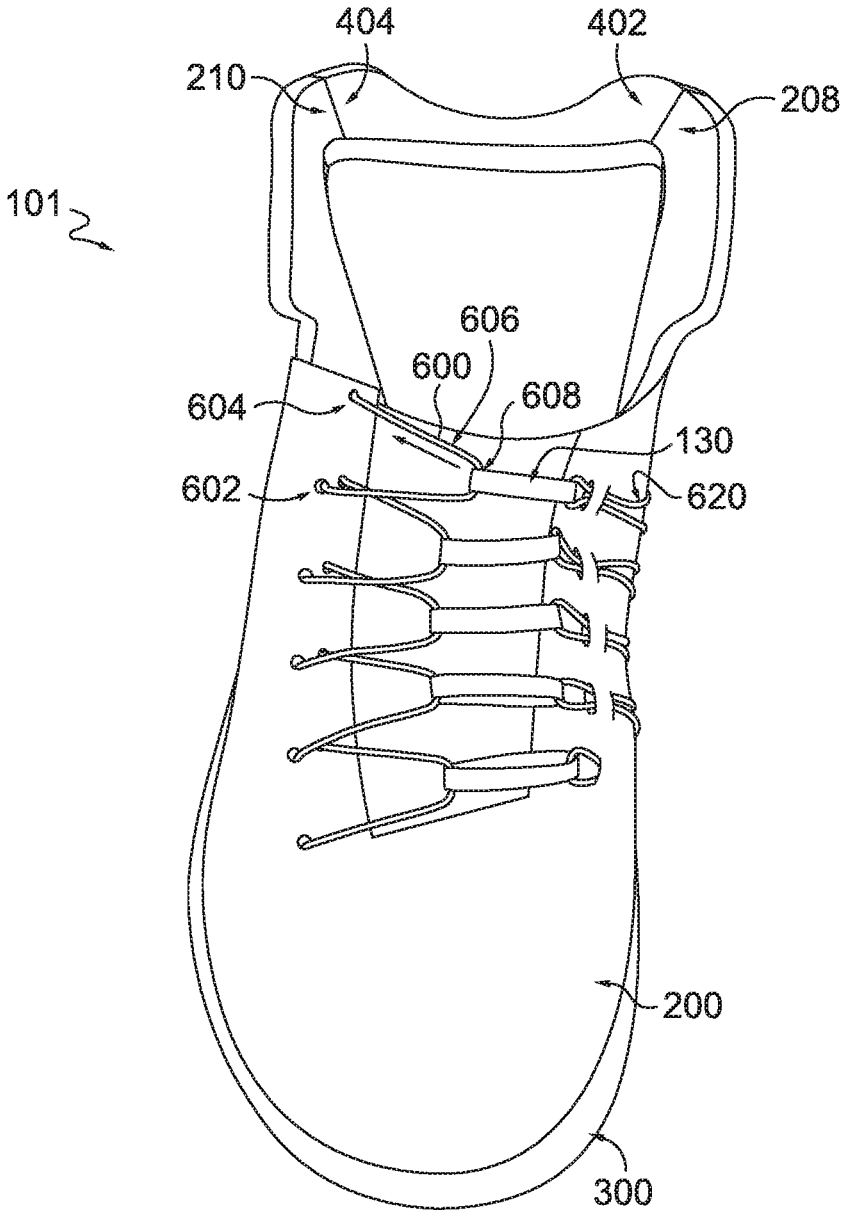
FIG. 12 depicts an alternative configuration of an easier access article of footwear, in accordance with aspects hereof.

FIG. 12 depicts a top perspective of an article of footwear 101, in accordance with aspects hereof. The article of footwear 101 is similar to the previously discussed article of footwear 100. However, the article of footwear 101 of FIG. 12 provides an alternative configuration for the plurality of tensioning strands 600. For example, the first portion 602 and the second portion 604 may be at least partially obscured by a portion of the upper 200. In the illustrated aspect the example strand part of the first portion 602 and part of the second portion 604 are exposed to an exterior of the article of footwear 101 proximate the intermediate portion 606 with the remainder of the first portion 602 and the second portion 604 extending between an outer portion of the upper 200 and the wearer's foot. This configuration allows for positional control of the tensioning strands as tension is applied, in an exemplary aspect.

Also depicted is the non-linear segment of the intermediate portion 606 is directed through an element of the forefoot lacing mechanism 130. As tension is applied by the tensioning strap 500, each strand of the plurality of tensioning strands 600 slides through the forefoot lacing mechanism 130 such that the non-linear segment changes relative position along the length of such strand. In other words, the first portion 602 may be longer when the article of footwear 101 is in the open configuration and may be shorter when the article of footwear 101 is in the closed configuration and tension is applied to the tensioning strap 500. Likewise, the reverse may be true for the second portion 604. This results from the strand sliding through the opening, loop, hook, or other element of the forefoot lacing mechanism 130. The forefoot lacing mechanism 130, which may be elastic or non-elastic, applies a securing force across the forefoot portion as a second end of the forefoot lacing mechanism 130 is anchored to a tensioning strand of a second plurality of tensioning strands 620. The second plurality of tensioning strands 620 may be statically secured to the article of footwear 101 to serve as a constant anchor. In an alternative aspect, a tensioning strap, similar to the tensioning strap 500, is joined with an end of each of the second plurality of tensioning strands 620 to translate tension to the forefoot lacing mechanism 130 from the second plurality of tensioning strands 620 additionally or alternatively.

As can be appreciated from the foregoing, aspects contemplate an easy access shoe. While specific embodiments are provided for illustration purposes, alternative configurations are contemplated while still achieving an easy access shoe. For example, while a separate tensioning strap and tensioning strand are discussed, it is contemplated that the tensioning straps and strands may be a common element or formed from a common material. Further, as previously provided, it is contemplated that the tensioning strands may be omitted in whole or in part. Also, it is contemplated that one or more magnetic elements may be incorporated in the shoe at any location to aid in achieving a closed configuration and/or to aid in aligning the heel cup. Even further, it is contemplated that one or more clips, buckles, straps, strands, zippers, hook-and-loop, and the like may be integrated into the footwear to further aid in achieving an easy access shoe.

Donning or doffing an easier access shoe is contemplated as including articulating a heel cup from an open configuration to a closed configuration. The articulation may be a pivoting, flexing, bending, rotating, or the like motion to move the heel cup from the closed position to an open configuration. An open configuration allows for easier longitudinal access to the foot-receiving cavity than the closed configuration. The method continues with releasably securing the heel cup to an upper with magnetic attraction. For example, one or magnetic elements (e.g., rare-earth magnets (neodymium magnets, samarium-cobalt magnets), ferrite, alnico) may be positioned on or within the upper and or sole and one or more magnetic elements may be positioned on or within the heel cup. The orientation, polarity, or configuration of the magnetic elements allows for magnetic fields to attract the heel cup to the upper in a way that mates the heel cup with the upper to enclose the heel end of the article of footwear in a closed configuration. The use of magnets helps align the position of the heel cup relative to the upper. Also, the magnetic elements aid in bringing the heel cup to a closed configuration.

The method may also include securing a tensioning strap around the heel cup. A first end of the tensioning strap is joined, in an exemplary aspect, with a plurality of tensioning strands on a first side of the article of footwear and a second end of the tensioning strap releasably secures to the article of footwear on an opposite second side of the article of footwear. For example, the second end may have a hook-and-loop, magnetic, hook, clasp, or other securing mechanism to releasably secure the second end of the tensioning strap to the article of footwear, such as at the upper, the sole, or a component in connection therewith. The secured tensioning strap may also transfer force to the tensioning strands that in turn provide a securing force across a forefoot portion of the article of footwear.

Some aspects of this disclosure have been described with respect to the illustrative examples provided by FIGS. 1-12. Additional aspects of the disclosure will now be described that may be related to subject matter included in one or more claims of this application, or one or more related applications, but the claims are not limited to only the subject matter described in the below portions of this description. These additional aspects may include features illustrated by FIGS. 1-12, features not illustrated by FIGS. 1-12, and any combination thereof. When describing these additional aspects, reference may or may not be made to elements depicted by FIGS. 1-12.

One aspect disclosed herein is directed to an article of footwear having a medial side, a lateral side, a toe end, and a heel end. The article of footwear may include an upper, a sole, a heel cup, and a strap. The upper may have a medial side, a lateral side, and a toe end extending between the medial side and the lateral side. The upper also have a medial heel edge and a lateral heel edge. The medial heel edge and the lateral heel edge may be opposite from the toe end in a longitudinal direction of the article of footwear. The sole may have a medial side, a lateral side, a toe end, and a heel end. The heel cup may be articulated at the heel end of the article of footwear. The heel cup may have a medial edge, a lateral edge, a collar edge, and a hinge edge. The heel cup may articulate between an open configuration that exposes an interior foot-receiving cavity of the article of footwear and a closed configuration that encloses a heel-end portion of the interior foot-receiving cavity. The strap may extend from the article of footwear medial side to the article of footwear lateral side around the heel cup when the heel cup is in the closed configuration. The strap may be releasably secured at one of the article of footwear medial side or the article of footwear lateral side.

In some aspects, the article of footwear may also include one or more magnetic elements in one of the upper, the heel cup, or the upper and the heel cup. The one or more magnetic elements may be positioned in the medial heel edge and the lateral heel edge. The one or more magnetic elements may also be positioned in the heel cup medial edge and the heel cup lateral edge.

In other aspects, the upper may be coupled with the sole at least at the sole medial side, the sole lateral side, and the sole toe end. The heel cup may be moveably coupled with the sole at the sole heel end. The heel cup may be moveably coupled with the upper between the medial heel edge and the lateral heel edge.

In still other aspects, the article of footwear may also include a first tensioning strand. The first tensioning strand may have a first end opposite a second end. The first tensioning strand may be coupled to the article of footwear at a transition between the upper and the sole. The second end may be coupled to the strap. The first tensioning strand may moveably engage a forefoot lacing element between the first end and the second end. The forefoot lacing element may include an opening and the first tensioning strand may pass through the opening. The forefoot lacing element may have a greater modulus of elasticity than the first tensioning strand. The forefoot lacing element may extend between the medial side of the upper and the lateral side of the upper. The strap may be coupled with a plurality of tensioning strands on either the lateral side of the article of footwear or the medial side of the article of footwear. Each of the plurality of tensioning strands may be fixedly joined with the article of footwear at a respective first end and coupled with the strap at a second end of each of the plurality of tensioning strands.

Another aspect disclosed herein is directed to a securing mechanism for an article of footwear. The securing mechanism may include a plurality of tensioning strands, a tensioning strap, and a plurality of forefoot lacing elements. The plurality of tensioning strands may include a first tensioning strand and a second tensioning strand. Each of the plurality of tensioning strands may have respective first ends opposite respective second ends. The tensioning strap may have a first strap end. The first end of each of the first tensioning strand and the second tensioning strand may be coupled to the first strap end. The plurality of forefoot lacing elements may include a first element and a second element. Each of the plurality of forefoot lacing elements may have an opening. The first tensioning strand may extend from the tensioning strap in a first direction and pass through the first element opening whereafter the first tensioning strand may extend in a second direction. The second tensioning strand may extend from the tensioning strap in a third direction and pass through the second element opening whereafter the second tensioning strand may extend in a fourth direction.

In other aspects, the securing mechanism may also include a releasable fastener coupled to the tensioning strap at a second strap end. The releasable fastener may be at least a portion of a hook and loop fastener. The plurality of tensioning strands be a first plurality of tensioning strands. The securing mechanism may also have a second plurality of tensioning strands including a third tensioning strand and a fourth tensioning strand. Each of the second plurality of tensioning strands may have a first end. Each of the plurality of forefoot lacing elements may have a first end opposite a second end. The third tensioning strand may be coupled to the first element on an opposite end from the first tensioning strand. The fourth tensioning strand may be coupled to the second element on an opposite end from the second tensioning strand.

Another aspect disclosed herein is directed to a method of securing an article of footwear. The method may include articulating a heel cup from an open configuration to a closed configuration, releasably securing the heel cup to an upper with magnetic attraction, and securing a tensioning strap around the heel cup. A first end of the tensioning strap may be joined with a plurality of tensioning strands on a first side of the article of footwear. A second end of the tensioning strap may be releasably secureable to the article of footwear on a second side of the article of footwear. The first side may be opposite the second side.

In other aspects, the method of securing an article of footwear may also include pulling a first tensioning strand of the plurality of tensioning strands through a forefoot lacing element in response to securing the tensioning strap. A first end of the first tensioning strand may be secured to the article of footwear and a second end of the first tensioning strand may be joined with the tensioning strap.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

While specific elements and steps are discussed in connection to one another, it is understood that any element and/or steps provided herein is contemplated as being combinable with any other elements and/or steps regardless of explicit provision of the same while still being within the scope provided herein. Since many possible embodiments may be made of the disclosure without departing from the scope thereof, it is to be understood that all matter herein set forth or shown in the accompanying drawings is to be interpreted as illustrative and not in a limiting sense.

The invention claimed is:

1. A footwear article comprising:

a sole;

an upper coupled to the sole, the upper having a first side, a second side, a toe end, and a heel end;

a heel cup articulated at the heel end along a heel edge extending from the first side of the upper to the second side of the upper, wherein the heel cup articulates between an open configuration that exposes an interior foot-receiving cavity of the footwear article and a closed configuration that encloses a heel-end portion of the interior foot-receiving cavity;

a tensioning strand having a first portion and a second portion, the first portion anchored to the footwear article on the first side of the upper at a biteline at an intersection of the upper and the sole of the article of footwear; and a strap coupled to the second portion of the tensioning strand, the tensioning strand and strap sequentially wrapping from the first side and around the heel cup to the second side, when the heel cup is in the closed configuration, wherein the strap is releasably secured to the second side of the upper.

2. The footwear article of claim 1 further comprising, a living hinge along an inferior edge of the heel cup, the living hinge coupling the heel cup to the upper.

3. The footwear article of claim 1, wherein the at least one tensioning strand extends from the first portion in a vertical orientation to a lacing element, and wherein, at the lacing element, the at least one tensioning strand transitions from the vertical orientation to a longitudinal orientation and towards the heel end.

4. The footwear article of clam 1, wherein the strap is releasably secured to the first side of the upper.

5. The footwear article of claim 1, wherein the strap is releasably secured to the first side of the upper and to the heel cup.

6. The footwear article of claim 1, wherein the heel cup includes a magnetic element to releasably connect to another portion of the footwear article.

7. The footwear article of claim 1 further comprising, a lacing element, wherein the tensioning strand is slidably coupled to the lacing element and wherein at least a portion of the tensioning strand and the lacing element extend in the medial-to-lateral orientation.

8. A footwear article comprising:

a tensioning strand having a first portion opposite a second portion, the first portion anchored to the footwear article along a biteline at an intersection of the upper and the sole of the footwear article;

a tensioning strap having a first strap end and a second strap end, the second portion of the tensioning strand coupled to the first strap end, the second strap end comprising a releasable fastener; and a forefoot lacing element comprising an opening, wherein the tensioning strand extends from the first portion at the biteline in a first vertical orientation and passes through the opening of the forefoot lacing element at which the tensioning strand transitions to a longitudinal orientation and extends towards a posterior of the footwear article.

9. The footwear article of claim 8, wherein the first strap end is coupled to the second portion of the tensioning strand on a first side of the footwear article, and wherein the releasable fastener of the second strap end connects to a second side of the footwear article opposite the first side.

10. The footwear article of claim 8, wherein the tensioning strap releasably connects to a first side of the footwear article and a second side of the footwear article.

11. The footwear article of claim 8, wherein a segment of the tensioning strand, the forefoot lacing element, or any combination thereof extends in a medial-to-lateral orientation.

12. The footwear article of claim 8, wherein a segment of the tensioning strand, the forefoot lacing element, or any combination thereof extends across a forefoot portion of the footwear article.

13. The footwear article of claim 8, wherein a portion of the strap between the first strap end and the second strap end wraps around a heel end of the footwear article.

14. The footwear article of claim 8, wherein the first portion of the tensioning strand is anchored on a first side of the footwear article and the forefoot lacing element is anchored on a second side of the footwear article, and wherein the tensioning strap wraps around a heel end of the footwear article.

15. The footwear article of claim 8, wherein the opening is a loop.

16. A footwear article comprising:

an upper having a medial side, a lateral side, a toe end, and a heel end;

a heel cup articulated at the heel end along a heel edge extending from the medial side to the lateral side, wherein the heel cup articulates, on a living hinge connecting the inferior edge of the heel cup to the upper, between an open configuration that exposes an interior foot-receiving cavity of the footwear article and a closed configuration that encloses a heel-end portion of the interior foot- receiving cavity;

at least one tensioning strand having a first portion and a second portion, the first portion anchored to the footwear article at a biteline on the medial side of the upper;

a lacing element, wherein the at least one tensioning strand extends from the first portion in a vertical orientation, and wherein, at the lacing element, the at least one tensioning strand transitions from the vertical orientation to a longitudinal orientation and towards the heel end; and a strap coupled to the second portion of the tensioning strand, the strap wrapping from the medial side and around the heel cup to the lateral side of the upper, when the heel cup is in the closed configuration, wherein the strap is releasably secured to the lateral side of the upper.

17. The footwear article of claim 16, wherein the at least one tensioning strand, the lacing element, or any combination thereof, extends in a medial-lateral orientation.

18. The footwear article of claim 16, wherein the strap releasably attaches to one or more of the medial side of the upper and the heel cup.

19. The footwear article of claim 16, wherein the heel cup includes a magnetic element.

* * * * *